US009677844B2

(12) United States Patent
Pelkey

(10) Patent No.: US 9,677,844 B2
(45) Date of Patent: Jun. 13, 2017

(54) TELESCOPING BATON WITH IMPROVED STOPPING AND SHOCK ABSORBING ASSEMBLY

(71) Applicant: Starkey Industries, LLC, Fitzwilliam, NH (US)

(72) Inventor: Gary L. Pelkey, Rindge, NH (US)

(73) Assignee: Starkey Industries, LLC, Fitzwilliam, NH (US)

( * ) Notice: Subject to any disclaimer, the term of this patent is extended or adjusted under 35 U.S.C. 154(b) by 0 days.

(21) Appl. No.: 14/199,280

(22) Filed: Mar. 6, 2014

(65) Prior Publication Data

US 2014/0256453 A1 Sep. 11, 2014

Related U.S. Application Data

(60) Provisional application No. 61/773,315, filed on Mar. 6, 2013.

(51) Int. Cl.
*F41B 15/02* (2006.01)

(52) U.S. Cl.
CPC ..... *F41B 15/027* (2013.01)

(58) Field of Classification Search
CPC ..... F41B 15/027
USPC ..... 463/47.7; 135/75; 403/109.1, 377
See application file for complete search history.

(56) References Cited

U.S. PATENT DOCUMENTS 5,160,140 A 11/1992 Starrett
5,320,348 A * 6/1994 Starrett ..... 463/47.6
5,356,139 A 10/1994 Parsons
5,372,363 A 12/1994 Siddle
D359,338 S 6/1995 Starrett
5,568,922 A 10/1996 Siddle
5,595,386 A * 1/1997 Parsons ..... 463/47.7
5,690,552 A 11/1997 Siddle
D395,069 S 6/1998 Starrett
5,839,630 A 11/1998 Dunstan et al.
D404,789 S 1/1999 Starrett
5,867,942 A 2/1999 Kowalski
5,961,387 A 10/1999 Parsons
6,056,643 A 5/2000 Wilmoth, III
6,089,449 A 7/2000 Butterworth
H1947 H 3/2001 Starrett
D440,273 S 4/2001 Hindi
6,213,672 B1 * 4/2001 Varga ..... A47L 13/20 15/144.4
6,231,447 B1 5/2001 Pelkey
6,238,292 B1 5/2001 Pelkey
6,398,653 B1 6/2002 Chang
6,463,688 B1 10/2002 Idehara
6,761,501 B1 7/2004 Nakatani
6,761,639 B2 7/2004 Todd
7,491,126 B2 2/2009 Jung
8,231,474 B2 7/2012 Stethem
8,926,214 B2 * 1/2015 Lah ..... A45B 9/00 135/75
2006/0163016 A1 * 7/2006 Ferkany ..... 188/288
2013/0081273 A1 * 4/2013 McAndrews et al. ..... 29/896.91
2014/0326556 A1 * 11/2014 Ruhlman et al. ..... 188/322.18

* cited by examiner

*Primary Examiner* — William Pierce

(57) ABSTRACT

An expandable or telescoping police baton embodies a cylindrical sleeve within which is slidably disposed cylindrical shaft. The sleeve and shaft are aligned with a slot and a pin to prevent rotation of the shaft within the sleeve. The baton also includes a shock absorbing assembly positioned on the shaft.

6 Claims, 8 Drawing Sheets

TELESCOPING BATON WITH IMPROVED STOPPING AND SHOCK ABSORBING ASSEMBLY

CROSS-REFERENCE TO RELATED APPLICATIONS

This application claims the benefit of U.S. Provisional Patent Application Ser. No. 61/773,315 filed Mar. 6, 2013, the disclosure of which is hereby incorporated herein by reference.

BACKGROUND OF THE INVENTION

Conventional police batons were at one time in the form of a rigid, one-piece, elongate, inextensible structure of solid cross section. Improvements in such batons include those shown in U.S. Pat. No. 5,160,140, and U.S. Pat. No. 5,320,348, which disclose a two-piece structure comprising a rigid, elongate, tubular structure and a rigid, elongate shaft disposed in the tube and movable therein relative to the tube from a collapsed or retracted position to an expanded or extended position. These patents are hereby incorporated herein by reference.

The present invention represents yet another improvement in the field of police batons, which allows the police officer to carry the police baton much more easily when it is in the refracted position, provides enhanced absorption of impact between elements of the baton, and improves the alignment of the elements of the baton with respect to one another.

SUMMARY OF THE INVENTION

Certain aspects of the present invention are directed to an expandable police baton embodying a cylindrical sleeve within which is slidably disposed a cylindrical shaft. The sleeve and shaft are aligned with a keyway slot and a spring loaded pin to prevent rotation of the shaft within the sleeve. The baton also includes a shock absorbing assembly positioned on the shaft and engageable with the sleeve.

As described above, the present invention is an improvement over the police batons shown in U.S. Pat. No. 5,160,140 and U.S. Pat. No. 5,320,348. These prior baton designs use a shock absorbing assembly that, first makes use of point loading at the impact point, which creates force on one side of the shock absorbing assembly—which can cause damage to the baton; and also incorporates a non-cylindrical shaft to lock the shaft and prevent it from rotating within the sleeve, which can make opening and closing the baton sometimes difficult. The present invention provides improvements for both of these issues.

In accordance with a first aspect, a police baton includes a hollow sleeve, frame or sleeve in which there is provided a cylindrical shaft which is supported in the sleeve for back and forth movement. The shaft is cylindrical and supports a radial groove proximate an end of the shaft to house a rubber o-ring and two identical "C" shaped stop collars that comprise the improved stopping shock absorbing assembly of this invention. The shaft also supports a blind hole or aperture just above the groove to house a spring and shouldered pin that rides in a keyway (slot) to align the shaft, thereby keeping it from rotating inside the sleeve and guiding the shaft, allowing the shaft to slide to a hole or aperture in the cylindrical sleeve which allows the button to protrude through the sleeve, thereby locking the shaft into an extended position.

The shock absorbing assembly is provided on the shaft and cooperates with a stop plug or cap of the sleeve providing 360 degree contact to prevent the shaft from extending outwardly from the sleeve more than a predetermined distance. The shock absorbing assembly provides enhanced energy absorption when the shaft is caused by the user to move rapidly to an extended position. Previous inventions have stops that point load the impact of the shaft when it is extended rapidly, causing damage to the shock absorbing assembly. The described improved shock absorbing assembly provides consistent contact around the entire shock absorbing assembly eliminating possible damage when the shaft is rapidly deployed to its extended position.

By providing a completely cylindrical shaft, any flat surfaces or sharp edges that could cause damage to contacted persons are eliminated.

Aspects of the police baton can include a side handle baton or straight baton configuration.

BRIEF DESCRIPTION OF THE DRAWINGS

The invention will now be described in greater detail with reference to the accompanying drawings, wherein.

Figure 1:
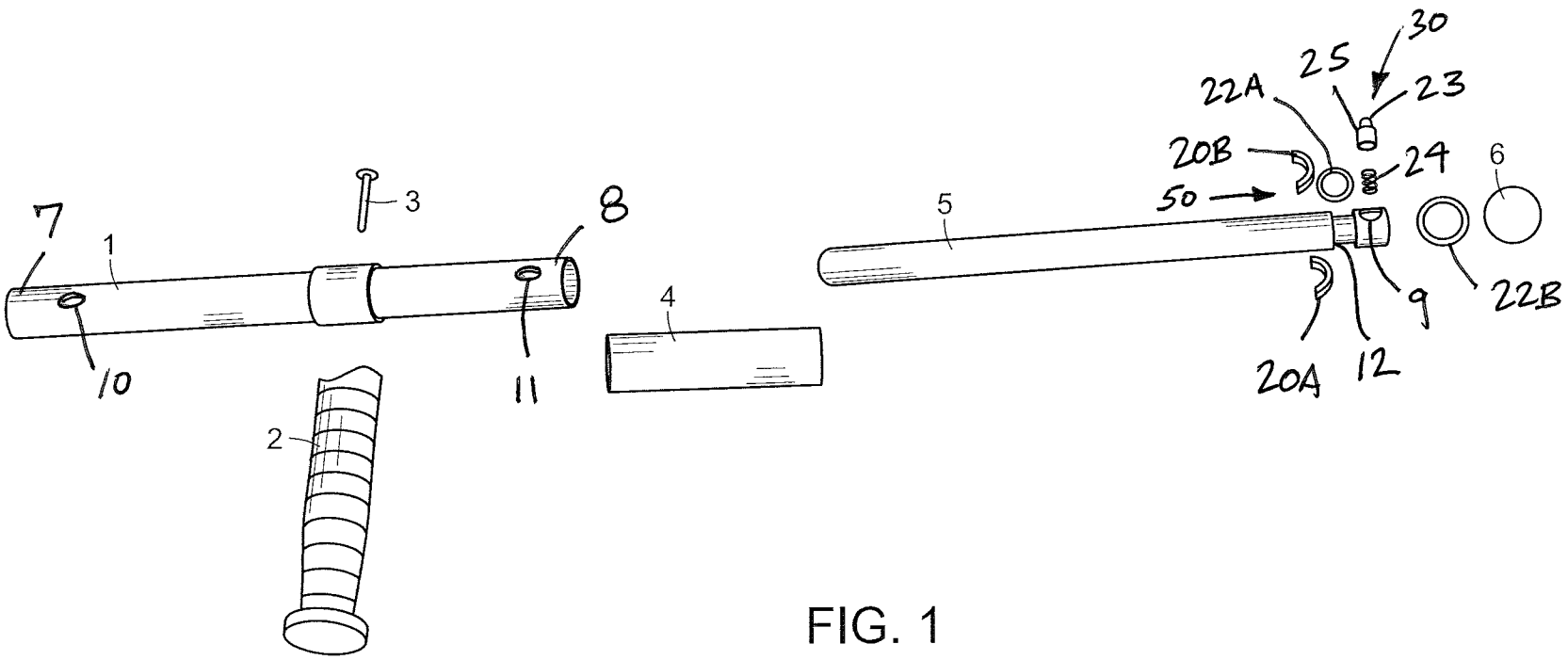
FIG. 1 is an exploded view of an embodiment of a police baton.
Figure 2:
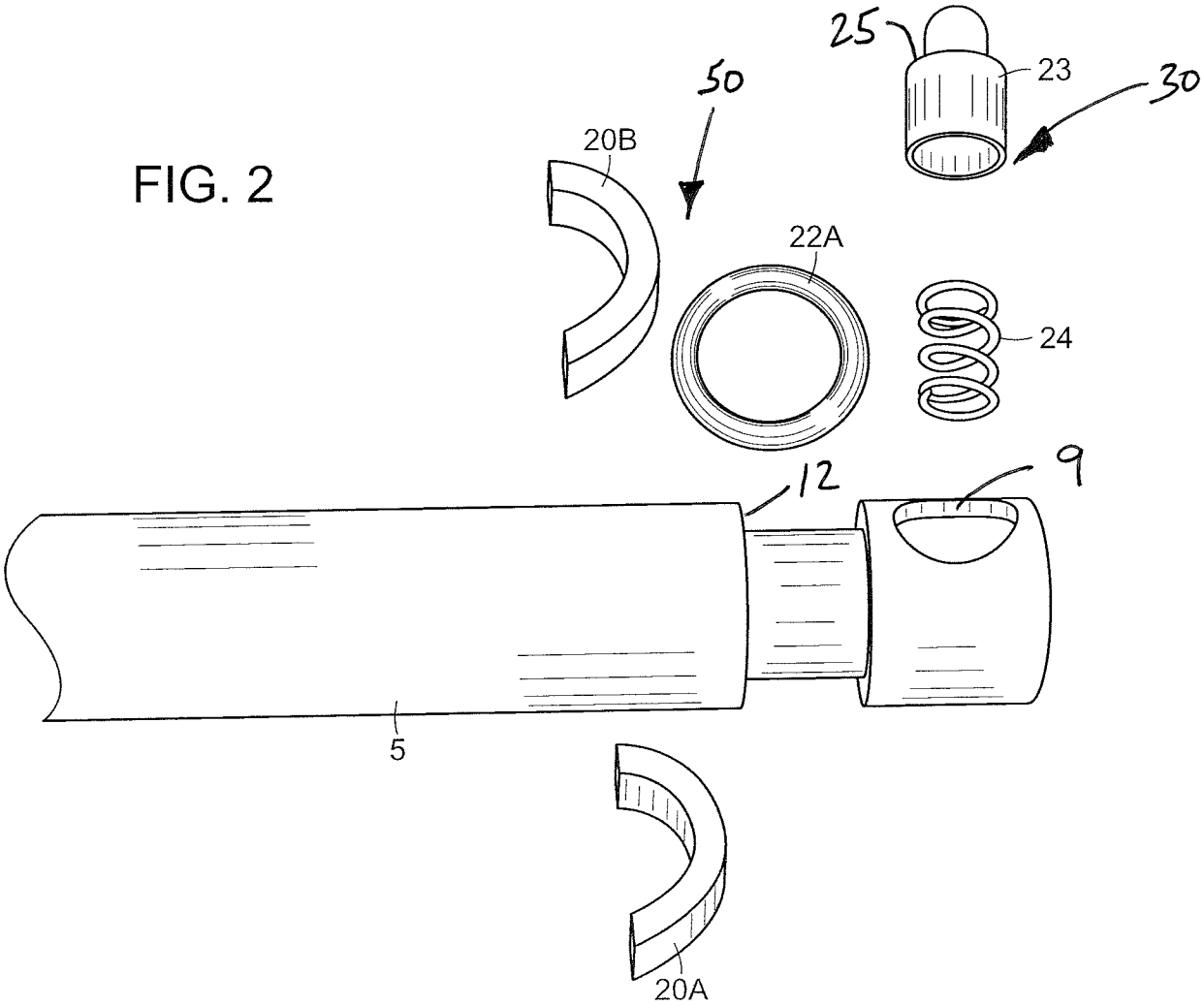
FIG. 2 is an exploded view of a portion of the shaft of the baton of FIG. 1, shown prior to assembly.
Figure 3:
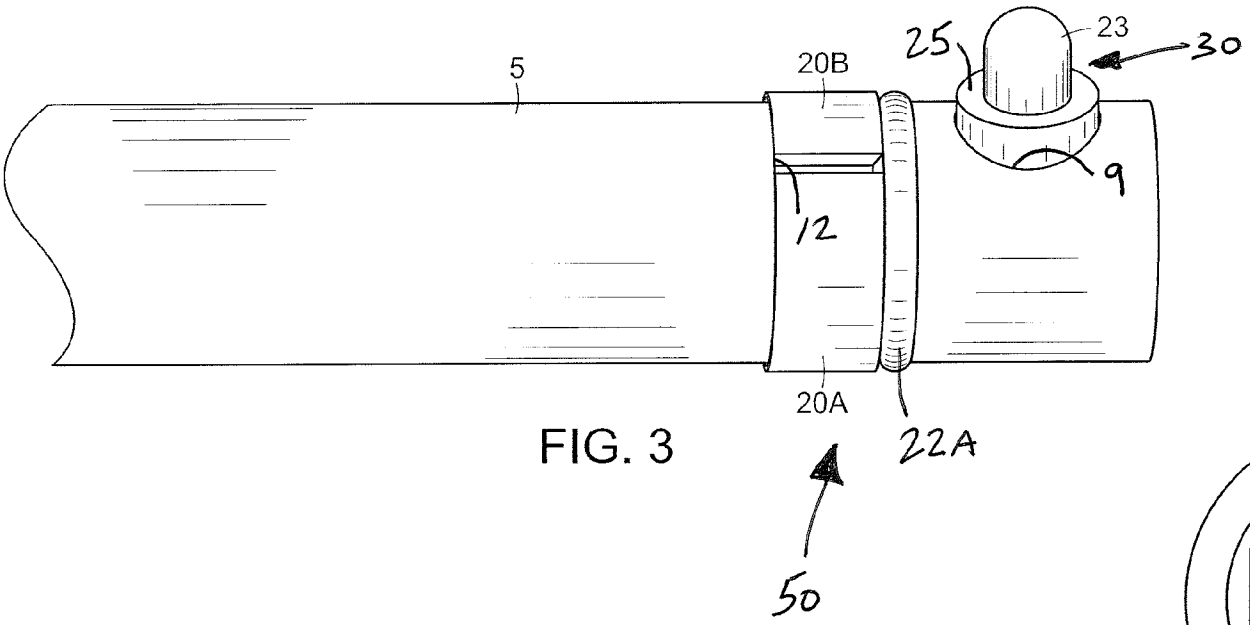
FIG. 3 is an elevation view of the portion of the shaft of the baton of FIG. 2. shown in an assembled condition.

The figures referred to above are not drawn necessarily to scale, should be understood to provide a representation of particular embodiments of the invention, and are merely conceptual in nature and illustrative of the principles involved. Some features of the police baton have been enlarged or distorted relative to others to facilitate explanation and understanding. The same reference numbers are used in the drawings for similar or identical components and features shown in various alternative embodiments. Police batons as disclosed herein would have configurations and components determined, in part, by the intended application and environment in which they are used.

DETAILED DESCRIPTION OF THE INVENTION

Figure 7:
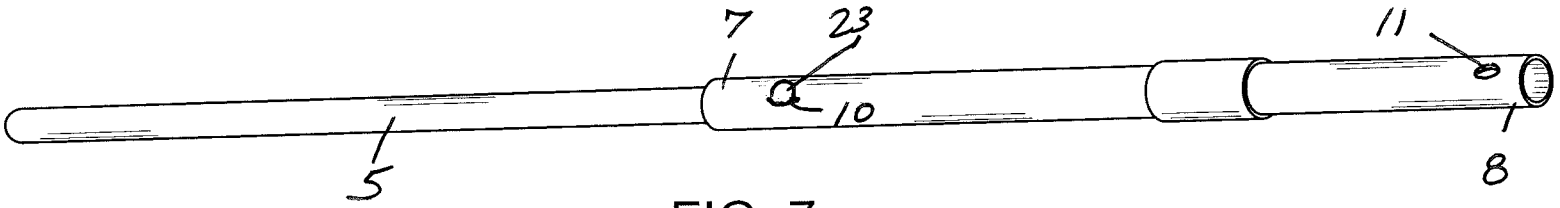
FIG. 7 is an elevation view of the baton of FIG. 1 in an extended position.
Figure 8:
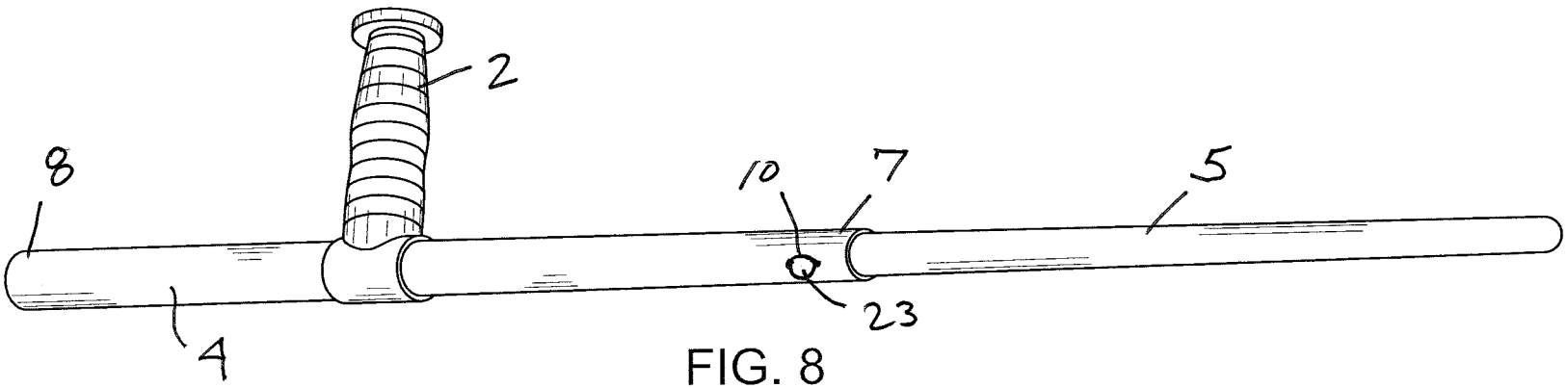
FIG. 8 is an elevation view of the baton of FIG. 1 in an extended locked position, shown with a side handle attached thereto.

A preferred embodiment of an expandable police baton is seen in FIG. 1 in exploded form, and includes a hollow cylindrical elongated frame or sleeve 1, having a first open end 7 and a second open end 8, and within which is slidably disposed a cylindrical shaft 5. Shaft 5 may be formed with a solid cross-section, and is configured to be telescopingly received in sleeve 1, as illustrated in FIGS. 5-8 below. Shaft 5 is configured to move between a first expanded or extended position, seen in FIGS. 7 and 8 below, where it extends outwardly from first open end 7 of sleeve 1 (to the left as seen in FIGS. 1 and 7, and to the right as seen in FIG. 8), and a second retracted position within sleeve 1. As shown in FIG. 1, shaft 5 has been removed from second end 8 of sleeve 1, and is positioned to the right of sleeve 1.

In certain embodiments, sleeve 1 is made of aluminum and anodized on its surface. In certain embodiments, shaft 5 is made of polycarbonate or aluminum and the like. Other suitable materials for sleeve 1 and shaft 5 will become readily apparent to those skilled in the art, given the benefit of this disclosure.

In certain embodiments, a radially-disposed side handle 2 may be secured to an exterior of sleeve 1. Side handle 2 may be fixed or secured to sleeve 1 with a side handle bolt or threaded screw 3 screwed into handle 2. Side handle 2 is shown in its attached condition in FIGS. 8 and 9, and a similar attachment and construction of a side handle is shown and described in U.S. Pat. No. 5,160,140.

Figure 9:
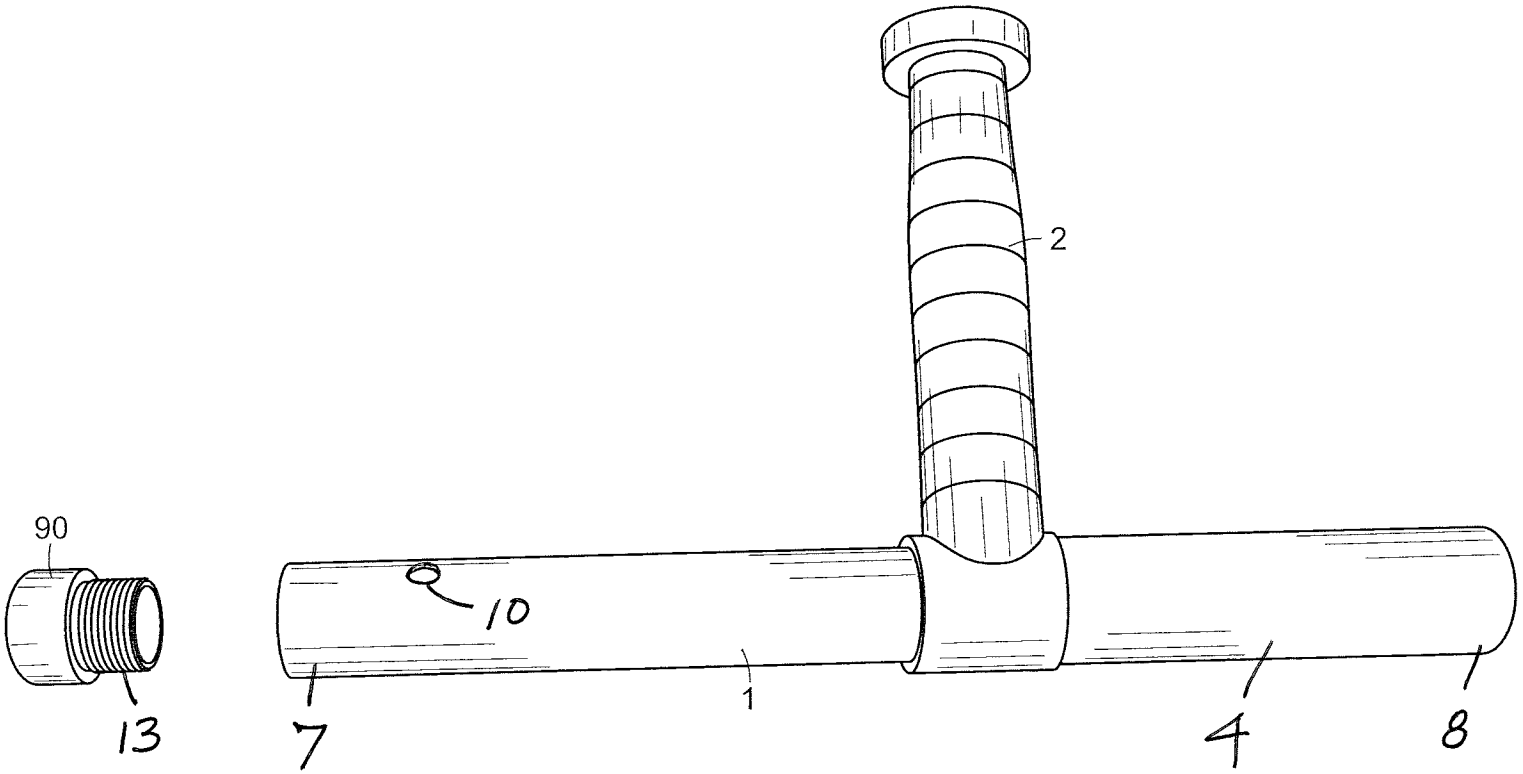
FIG. 9 is an elevation view of a portion of the sleeve of the baton of FIG. 1, shown with a side handle attached thereto and a stop cap removed from the end of the sleeve.

To afford a firm grip on the baton, a portion adjacent second end 8 of sleeve 1 may be covered with a foam, rubber, or knurled grip 4. As seen in FIGS. 8, 9, grip 4 may surround second end 8 of sleeve 1. In use, the user may grasp the baton with side handle 2, with second end 8 of sleeve 1 covered by grip 4, or with both of these portions.

When the baton is assembled and shaft 5 is received in sleeve 1, an end cap 6 may be secured to the open second end 8 of sleeve 1, thereby retaining or capturing shaft 5 within second end 8 of sleeve 1. End cap 6 may have external threads that are threaded into mating threads (not shown) on the inside of second end 8 of sleeve 1. An end cap O-ring 22B may be captured between end cap 6 and second end of sleeve 1. End cap 6 can be removed to permit shaft 5 to be removed from sleeve 1, as it is seen here in FIG. 1. End cap O-ring 22B may be formed of Buna rubber, or the like.

Figure 4:
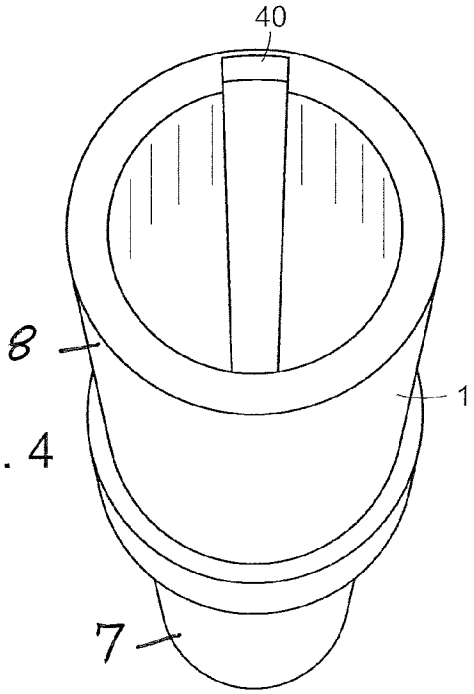
FIG. 4 is a perspective end view of the sleeve of the baton of FIG. 1.
Figure 5:
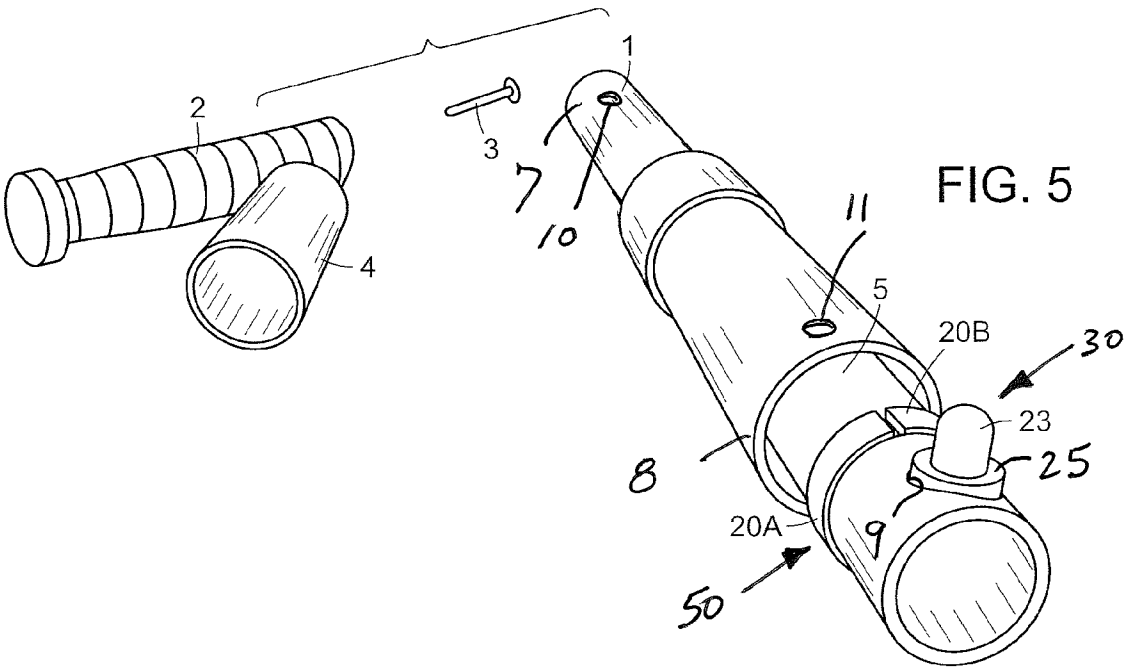
FIG. 5 is perspective view of the baton of FIG. 1, shown partially assembled, with the shaft loaded into the sleeve.
Figure 6:
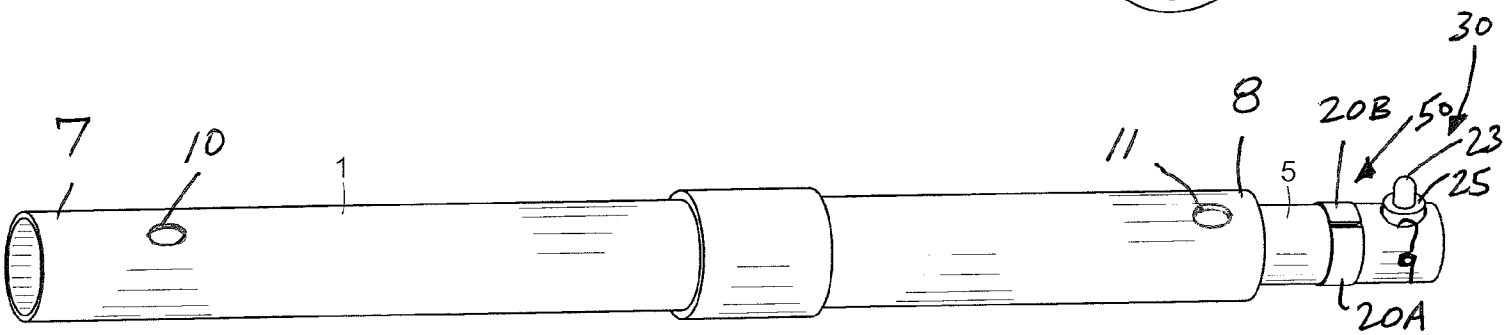
FIG. 6 is an elevation view of the shaft and sleeve of the baton of FIG. 1 in an assembled condition.

Shaft 5 is aligned with sleeve 1 by the engagement of a locking pin assembly 30 with a longitudinally extending slot or keyway 40 that is formed on an interior surface of and extending axially along sleeve 1, as can be seen in FIG. 4. Locking pin assembly 30 includes a locking pin 23 that acts as a key that is captured within, and engages with and moves along keyway 40 to prevent rotation of shaft 5 within sleeve 1 as sleeve 5 moves telescopingly with respect to sleeve 1.

A circumferential shoulder 25 extends about a central portion of locking pin 23. A pin spring 24 acts to bias locking pin 23 and shoulder 25 outwardly through an aperture 9 formed in shaft 5, while allowing locking pin 23 to be depressed by the user. When shaft 5 is in its extended position, pin 23 extends outwardly through a first counter bored hole or aperture 10 formed proximate first end 7 of sleeve 1, with shoulder 25 engaging the interior surface of sleeve 1 about the periphery of first aperture 10. When shaft 5 is in its retracted position, pin 23 and shoulder 25 are similarly engaged with a second counter bored hole or aperture 11 formed proximate second end 8 of sleeve 1. The construction of pin 23 and first and second apertures 10, 11 is similar to that disclosed in U.S. Pat. No. 5,160,140. It is to be appreciated that first and second apertures 10, 11 are aligned with and extend through keyway 40. Locking pin 23 may be formed of aluminum, and may have no coating or anodized finish on its surface. Other suitable materials for pin 23 will become readily apparent to those skilled in the art, given the benefit of this disclosure.

Figure 10:
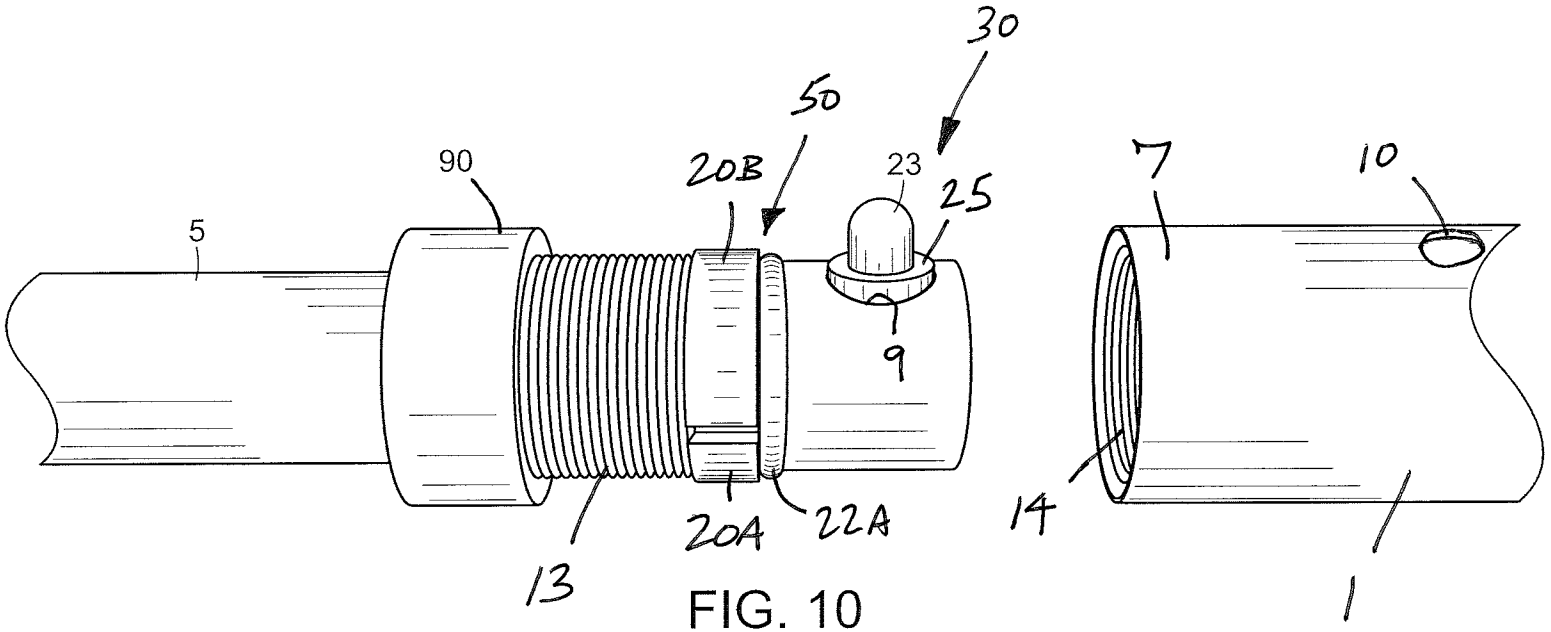
FIG. 10 is an elevation view, shown partially exploded, illustrating how the shock absorbing assembly on the shaft of the baton interacts with the stop cap in the baton of FIG. 1.
Figure 11:
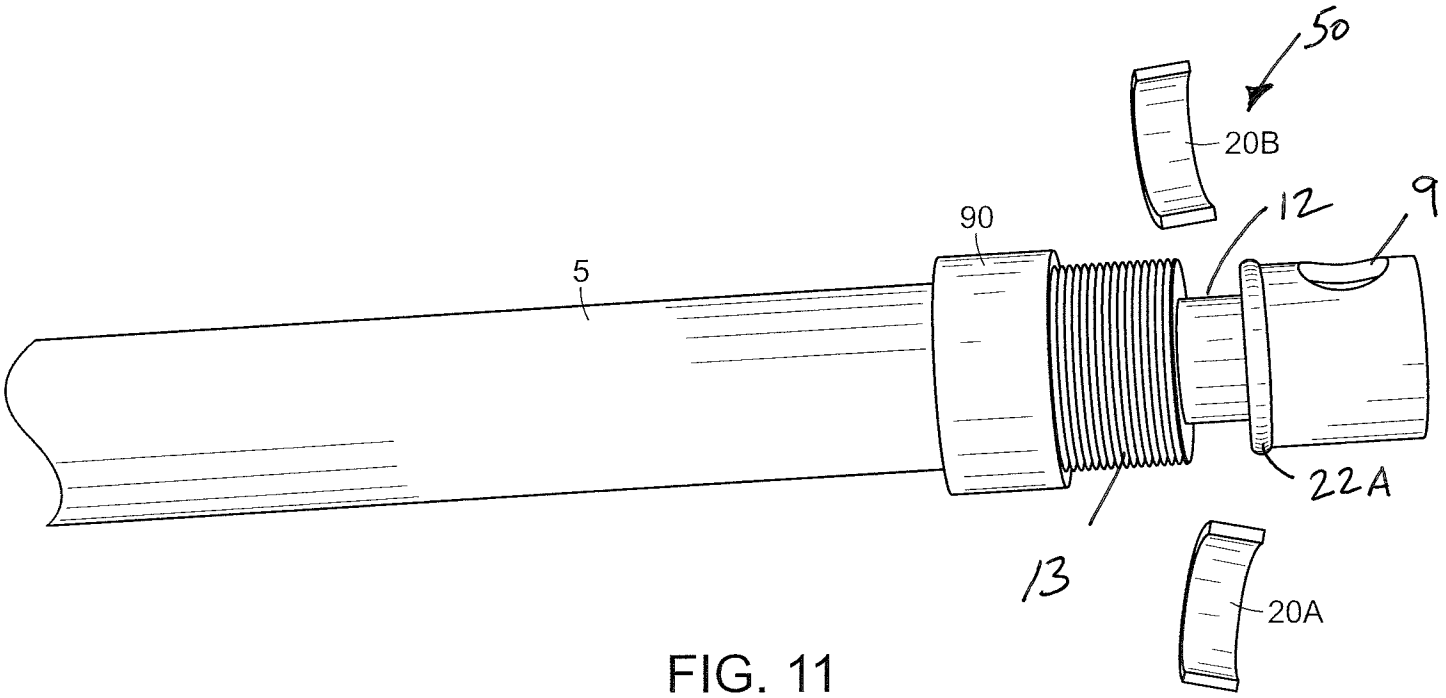
FIG. 11 is en elevation view, shown partially exploded, of the shaft of the baton of FIG. 1, with its two C-shaped collars removed from a groove in the shaft.

A shock absorbing assembly 50 is seen in FIGS. 1-3, 5, 6, 10, and 11, is positioned on shaft 5. Shock absorbing assembly 50 includes a pair of opposed C-shaped collars 20A, 20B and an elastomeric shaft O-ring 22A that are received in a radially formed groove 12 that extends about the circumference of shaft 5. Shock absorbing assembly 50 engages with a stop plug or cap 90 that is secured to first end 7 of sleeve 1 to limit forward movement of shaft 5 as it moves to its extended position. Stop cap 90 is seen in FIGS. 9-11, and includes external threads 13 that engage with internal threads 14 formed on first end 7 of sleeve 1. It is to be appreciated that in other embodiments, stop cap 90 could be secured to sleeve 1 by welding, riveting, or bonding. Other suitable means of securing stop cap 90 to sleeve 1 will become readily apparent to those skilled in the art, given the benefit of this disclosure.

FIG. 10 illustrates the engagement of shock absorbing assembly 50 of shaft 5 and stop cap 90, shown here with shaft 5 and stop cap 90 spaced from first end 7 of sleeve 1. Shaft 5 is shown extending to the left through stop cap 90, with C-shaped collars 20A, 20B abutting the end of stop cap 90 with a 360° contact, as they would when shaft 5 is moved to its extended position. In use, as shaft 5 moves to its extended position very quickly, collars 20A, 20B impact and abut with stop cap 90, causing compression of elastomeric O-ring 22A between collars 20A, 20B and the edge of groove 12, thereby absorbing some of the shock resulting from the impact of collars 20A, 20B with stop cap 90.

The C-shaped stop collars 20A, 20B may be formed of aluminum, hard plastic, or the like, and may be identical in shape. Elastomeric O-ring 22A may be formed of Buna rubber, or the like. Other suitable materials for stop collars 20A, 20B and O-ring 22A will become readily apparent to those skilled in the art, given the benefit of this disclosure.

When the baton is carried by a police officer prior to use, shaft 5 is usually in the retracted position within sleeve 1. To use the baton, the police officer sharply rotates their wrist and flicks the baton, which moves shaft 5 and causes pin 23 to move out of engagement with second aperture 11 and move outwardly along sleeve 1 to the extended position. When shaft 5 is in the extended position, pin 23 extends into and engages with first aperture 10, which retains shaft 5 in the extended position. To retract shaft 5, pin 23 is depressed by the police office below second aperture 10 to permit shaft 5 to be collapsed to its retracted position.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A police baton comprising a hollow sleeve having a handle end and a far end, wherein the sleeve includes a cylindrical shaft disposed therein, which is supported in the sleeve for back and forth movement;

wherein the shaft includes an internal radial groove proximate one end of the shaft to house a rubber O-ring and two identical "C" shaped stop collars to provide shock absorbing means for the baton;

wherein the shaft further includes an aperture located above the groove to house a spring and shouldered button that rides in a keyway to align the shaft, thereby keeping the shaft from rotating inside the sleeve, and thereby allowing the shaft to slide to a hole located in the far end of the cylindrical sleeve which allows the button to protrude through the sleeve, thereby locking the shaft into an extended position;

wherein the shock absorbing means is provided on the shaft and cooperates with a stop plug or cap of the sleeve providing 360 degree contact to prevent the shaft from extending outwardly from the sleeve more than a predetermined distance; and wherein shock absorbing means provides consistent contact to the baton assembly eliminating possible damage when the shaft is rapidly deployed to its extended position.

2. The police baton of claim 1, further comprising a side handle attached to an exterior of the sleeve.

3. The police baton of claim 1, further comprising a stop cap secured to the handle end of the sleeve;

wherein the C-shaped collars abut the stop cap when the shaft is in the extended position.

4. The police baton of claim 3, wherein the first end of the sleeve is internally threaded and the stop cap externally threaded.

5. The police baton of claim 1, further comprising an end cap secured to the far end of the sleeve.

6. The police baton of claim 1, further comprising a grip surrounding the handle portion of the sleeve.

* * * * *